United States Patent [19]

Klimek

[11] Patent Number: 4,813,124

[45] Date of Patent: Mar. 21, 1989

[54] BAKEABLE EVACUATIVE CONTAINER ASSEMBLY FOR HOT ISOSTATIC PRESSING

[75] Inventor: Joseph P. Klimek, South Amboy, N.J.

[73] Assignee: The United States of America as represented by the Secretary of the Army, Washington, D.C.

[21] Appl. No.: 81,961

[22] Filed: Jul. 20, 1987

[51] Int. Cl.[4] ..... H01F 7/06

[52] U.S. Cl. ..... 29/607; 100/3; 419/49; 419/68

[58] Field of Search ..... 29/607; 419/38, 49, 419/66, 68; 100/3

[56] References Cited

U.S. PATENT DOCUMENTS 4,366,007 12/1982 Inoue ..... 148/102

4,592,889 6/1986 Leupold ..... 29/607

*Primary Examiner*—Donald P. Walsh

*Attorney, Agent, or Firm*—Sheldon Kanars; Maurice W. Ryan

[57] ABSTRACT

A bakeable evacuative fabrication assembly for the production of permanent magnets formed by assembling discrete magnetic elements on a core, enclosing such assembly in a close-fitting container, providing end closures on said container, and providing a one of said end closures with a sealably closeable cold mold vent means.

8 Claims, 1 Drawing Sheet

BAKEABLE EVACUATIVE CONTAINER ASSEMBLY FOR HOT ISOSTATIC PRESSING

The invention described herein may be manufactured, used, and licensed by or for the Government of the United States of America for governmental purposes without the payment to me of any royalties thereon.

BACKGROUND AND FIELD OF THE INVENTION

The invention relates to the field of permanent magnet structures, and more particularly to the fabrication of permanent magnet core elements using hot isostatic pressing techniques for densification of the magnetic core materials. The invention is particularly advantageous in the construction of radially oriented magnet elements for use in miniaturized traveling wave tubes (TWTs). The unique method and apparatus according to the invention provides for the complete and leakproof sealing of a permanent magnet core assembly in fabrication process, after the degassification step, but prior to the hot isostatic pressing procedure, without the application of heat to effect the closure, thus insuring the elimination of adverse effects that closure steps involving heating, hot welding, or the like could, and would, most likely produce.

The utilization of permanent magnet structures and devices to replace electromagnetic type yokes in electronic apparatus, cathode ray tubes for instance, has received significant acceptance in the electronics industry. Precision and miniaturization which is attainable with permanent magnet type structures and assemblies is, for the most part, not attainable with the use of electromagnetic structures. Permanent magnets made according to the present invention find particularly advantageous application where the focusing of an electron beam in a given apparatus is a critical factor. Such devices include traveling wave tubes and extended interaction amplifiers which, in turn, find application in microwave/millimeterwave communications, radar, and jamming apparatus for military and national security use.

It has been found through experience in this area that radially oriented cores are most beneficial and frequently essential to the miniaturized periodic permanent magnet stack assemblies used. It has been further found that a preferred means of fabricating these structures is by the hot isostatic pressing technique. This method has been found superior to alternative and somewhat traditional methods of densification of cores such as sintering and the like procedues, where the structure is vulnerable to fracture and sometimes even severe cracking, rendering the product-in-process completely useless. The reasons for this are within the knowledge of artisans practicing the technology; the basic causes being due to extremely high strains introduced upon cooling of the elements which have been heated for the densification sintering and the like steps. Where different materials are used, there is, of course, the further problem of anisotropy in the thermal expansion coefficients of several different materials employed in fabricating or assembling the apparatus. A major disadvantage and problem with hot isostatic pressing techniques, prior to the time of the present invention, has been the effective accomplishment of degassification, and then the effective sealing off of the container being used in the process, without damaging the magnets being made. Heretofore, whenever some sort of heat sealing has been used after the degassification step, the product has been put at risk because of the detrimental effects of such heat.

The technique of fabricating permanent magnet elements through the methods of hot isostatic pressing generally has been known in the art. Traditionally, the steps of permanent magnet fabrication involve the vacuum melting and chill casting of some alloy of magnetic material, followed by a comminution of grinding of the alloy until it is milled and or hydrided to the preselected partical size and morphology for the desired end product.

The particalized material is thereafter disposed in a die press wherein it is isostatically compressed to the required degree of densification.

Traditionally, after the desired degree of densification had been attained, further steps in the manufacturing process including hipping, followed by heat treatment, and/or sintering followed by heat treatment. The cores or individual magnet elements thus produced are then machined to the desired configurations and tested for integrity by means of X-ray diffraction or metallography beam microscopy.

The rings would then be assembled into the desired magnetic elements, impulse magnetized, and measured for magnetometry evaluation or achievement. Radial field evaluations and transverse field distribution measurements are then made, in the nature of quality control checks.

The problems encountered with the prior art technique of manufacturing permanent magnet structures in accordance with the foregoing description were that the end products are less than completely satisfactory in any instance where the heat applied to the material in process after its densification would tend to bring about cracking, spalling, or other forms of magnetically detrimental phenomena to the discs and core pieces which were to be the major elements of the finished magnet.

BRIEF DESCRIPTION OF THE INVENTION

With this then being the state of the art, I conceived and developed my invention with the principle object of providing a method and apparatus for the production of relatively small permanent magnets, using isostatic hot pressing techniques towards the attainment of desired preselected densification qualities to the extent necessary to insure permanent magnetic and structural integrity, and wherein the critical fabrication step of sealing off after degassification is accomplished without the utilization or application of any heat which could detrimentally affect the magnetic and/or structural properties of the finished article.

In general, apparatus according to my invention comprehends a bakeable evacuative container assembly to fabricate a permanent magnet assembly, which comprises, in combination, a core element, a stack of magnetic substance elements disposed contiguously to each other on said core element, isostatically compressed at an elevated temperature to the desired degree of densification, an outer shell element disposed contiguously to the outer peripheral surface of the assembled stack of core elements, an end closure means permanently affixed to the outer shell and in contiguous bearing contact on the end of the stacked elements, a second end closure means arranged and disposed at the other end of the assembly, fixedly attached to the outer shell element and in contiguous contact with the other end of the stacked magnetic elements, with the important additional feature of a vent means provided extending from the second end closure means, this vent means being sealably closeable without the application of heat.

DETAILED DESCRIPTION OF THE INVENTION

The invention will now be described in greater detail and with reference to the drawing wherein.

Figure 1:
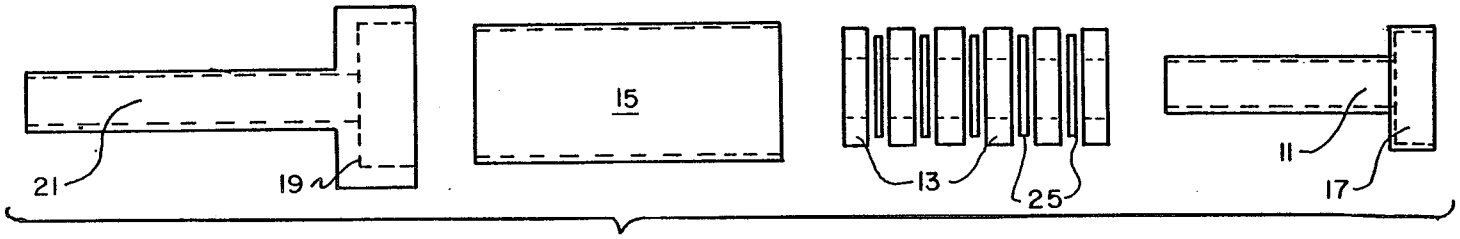
FIG. 1 is an exploded view of the several elements of apparatus according to the invention, arranged longitudinally and shown prior to assembly.
Figure 2:
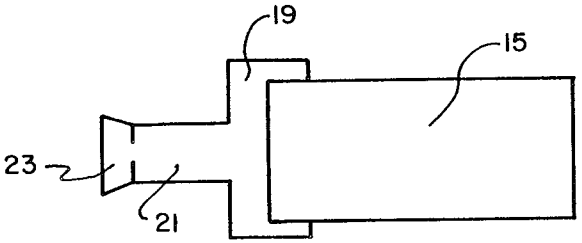
FIG. 2 shows apparatus according to the invention completely assembled and with the vent tube on the second end closure means pinchably closed.

Referring to FIG. 1, a multiplicity of magnetic substance core elements 13, disc-like in shape and provided with centrally registering holes, are assembled on a ferromagnetic core element 11, a hollow steel pin for instance, formed integrally with an end closure 17, also of stainless steel, and the entire assembly arranged to be disposed interiorly of an outer shell element 15, a thin-wall stainless steel tubing for example. Then separating washers 25 of slighty smaller diameter than the core elements 13 are arranged, one each between each two adjacent core elements 13.

The end closure 17 of stainless steel or the like, is arranged to close one end, the right end as shown in the drawing, of the assembly and this end closure is permanently affixed to the outer shell element 15 by a heliarc welding or the like permanent bonding technique at the completion of the assembly.

An end closure 19 is provided as shown at the left in FIG. 1 of the drawing. The end closure 19 is designed to fit over the end of the thin-wall tube outer shell 15 in a cap-like manner and to provide for the complete enclosure of the hollow pin element 11 and magnetic core elements 13 disposed interiorly of the outer shell. Extending longitudinally from the end closure 19 is a closeable vent tube 21. It has been found advantageous to dispose the vent tube centrally of the end closure element and in substantial alignment with the longitudinal dimension of the permanent magnet assembly.

In accordance with the present invention, the addition of heat after the densification process step is completely eliminated, because the pinchable tube 23 is closed off before the hot isostatic pressing but after degassification of the structure and this, as can be readily appreciated, is done without the application of any further heat such as could detrimentally affect either the brazing connection between the end closure cap 19 and outer shell element 15 or, more importantly, the magnetic integrity of the core element assembly composed of the magnetic substance core elements 13.

EXAMPLE

A working embodiment of the present invention was fabricated according to the following:

A multiplicity of SmCo magnet discs 13 was arranged in registration around a central hollow steel pin 1 formed integrally with an end closure 17 as shown in FIG. 1. Flat washers 25, about 1/32" thick and of diameter about 1/16" less than the disc diameter were interspersed between the disc 13, as shown. The assembled discs 13, pin 11, and end closure 17 were interiorly disposed in a stainless steel thin wall tube approximately 1 7/8" inches long and ¾" inch diameter. End closure 17, of stainless steel, was heliarc welded to the stainless steel outer shell element 15. In this example, a number 304 stainless steel tube with a 10 mil thick wall was used, and the tube was cut to a length of 1 7/8" inches. Prior to the insertion of the assembled pin, discs, washers and end closure 17 into tube 15, the end closure element 19, made of copper, was affixed to the other end of the assembly with PERMA BRAZE 130 brazing having a melting point of 950° C. After brazing of the closure cap 19 into place, insertion of the rest of the elements, and heliarc welding of the end closure 17 of the tubing 15, the assembly was tested for vacuum leaks.

The bake-out procedure involved holding the assembly at 400° C. (note that this temperature is substantially below the PERMA BRAZE temperature used to affix the end enclosure 19 to the shell) for at least one hour after insertion into the heat zone. At the end of this time, the assembly is removed from the furnace under a vacuum, cooled and cold-welded shut with a pinch-off tool by squeezing the end of the closeable vent tube 21 to form the pinched tube point 23. The use of the copper for end closure 19 permits what amounts to cold welding to effect the final sealing whereas, normal arc welding, requiring an argon or helium atmosphere, could not be tolerated since these gases would diffuse into the open pores of the low density cores and might easily reach a temperature higher than that use to effect the PERMA BRAZE connection of the end cap closure element 19 to the outer shell element 15.

Figure 3:
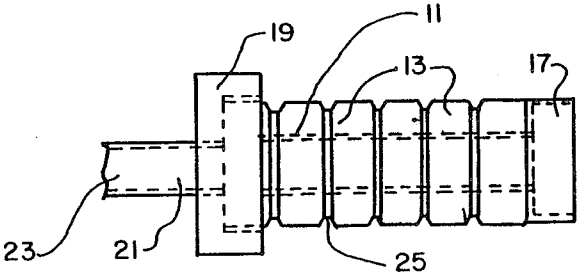
FIG. 3 shows a completed blank or ingot of magnets made according to the invention, after hot isostatic pressing, with the outer jackset element cut away, but prior to cutting up into discrete magnets.

FIG. 3 of the drawing shows a completed magnet blank or ingot with the main portion of the outer shed or tube 15 stripped away. Customarily, blanks of this type are cut up into smaller disc-like elements which are then magnetized and used as desired.

Numerous alternative structures and embodiments, all within the spirit of this invention, will be well within the skills of persons familiar with the art, upon their reading the foregoing disclosure. It is intended, therefore, that the disclosure be viewed as illustrative only and not construed in any limiting sense, it being my intention to define the invention by the appended claims.

What is claimed is:

1. A bakeable evacuative permanent magnet fabricating assembly comprising, in combination, a core element;

a stack of magnetic substance elements disposed adjacent each other on said core element, isostatically compressed at an elevated temperature;

an outer shell element disposed contiguously to an outer peripheral surface of said stack;

first end closure means arranged and disposed at one end of the assembly, fixedly attached to said outer shell element and in contiguous contact with an end of said stack;

second end closure means arranged and disposed at the other end of the assembly, fixedly attached to said outer shell element and in contiguous contact with the other end of said stack; and vent means in said second end closure means sealably closeable without the application of heat.

2. Apparatus according to claim 1 wherein said vent means comprises a pinchable closeable conduit.

3. Apparatus according to claim 1 wherein the core element is a solid ferromagnetic cylinder;

the magnetic substance elements are cylindrical discs;

the outer shell element is a relatively thin-walled cylindrical tube; the first end closure means is a concave dish element; the second end closure means is a cap-like structure fitted over and affixed to the outer shell element; and the vent means is a soft metal tube generally centrally disposed in and extending longitudinally from the second end closure means.

4. Apparatus according to claim 1 wherein the core element is a hollow ferromagnetic cylinder integrally formed with the first end closure means with its hollow interior communicating with the exterior of the apparatus; and the magnetic substance elements are cylindrical discs separated from each other by respective metallic washer elements, each of which is thinner and of less diameter than said magnetic substance cylindrical discs.

5. A method for making a permanent magnet device comprising the steps of assembling a stack of magnetic substance elements separated from each other by interspersed washer elements on a longitudinally extending core element disposed centrally of said stack and formed integrally with an end closure means;

inserting the assembled stack and core element into an outer shell and closing said end closure means;

assembling further end closure means over the open end of said assembly so as to effect closure thereof, said further end closure means being provided with vent means;

isostatically compressing and heating the assembly to a preselected temperature which will effect a preselected density of said magnetic substances and a preselected level of degassification within said structure; and closing the vent means in said further end closure means without the application of further heat for that purpose.

6. A method according to claim 5 wherein the vent closure step is effected by pinchably closing a soft metallic tubing extending longitudinally from said end closure element.

7. A method according to claim 5 wherein the end closure means is fixedly attached to the cylindrical outer shell element by means of brazing.

8. A method according to claim 5 wherein all of the structural elements are heat tolerable during the course of assembly but wherein the vent element is operably closeable without the application of heat.

* * * * *